United States Patent [19]

Howard

[11] Patent Number: 4,689,909

[45] Date of Patent: Sep. 1, 1987

[54] MAGAZINE CHARGER

[76] Inventor: William J. Howard, P.O. Box 573, Wilson, N.C. 27893

[21] Appl. No.: 886,043

[22] Filed: Jul. 16, 1986

[51] Int. Cl.[4] ..... F42B 39/06

[52] U.S. Cl. ..... 42/87

[58] Field of Search ..... 42/87, 88

[56] References Cited

U.S. PATENT DOCUMENTS

| | | | |
|---|---|---|---|
| 1,355,684 | 10/1920 | Northover . | |
| 1,786,537 | 12/1930 | Holek . | |
| 2,403,012 | 7/1946 | McPheters . | |
| 2,451,521 | 10/1948 | Uglum | 42/87 |
| 2,864,193 | 12/1958 | Drew . | |
| 4,538,371 | 9/1985 | Howard | 42/87 |
| 4,570,371 | 2/1986 | Mears . | |
| 4,574,511 | 3/1986 | Csongor | 42/87 |

FOREIGN PATENT DOCUMENTS

| | | | |
|---|---|---|---|
| 304379 | 2/1921 | Fed. Rep. of Germany | 42/87 |

*Primary Examiner*—Charles T. Jordan

*Attorney, Agent, or Firm*—Quaintance, Murphy & Presta

[57] ABSTRACT

A magazine charger having a body with a spring and an open end for receiving a magazine to be charged with cartridges. The body of the charger also has a closed end opposite the open end. The charger is equipped with a plunger axially, slidably carried by the closed end of the body. The plunger is adapted to move cartridges against the magazine spring. The charger also has a plunger spring which biases the plunger away from the open end of the charger. The plunger is operable to sequentially depress the uppermost cartridge, facilitating feeding of the cartridges to the magazine.

11 Claims, 10 Drawing Figures

MAGAZINE CHARGER

Charging cartridges to the magazine of a firearm has always been slow and cumbersome. For members of the armed forces in combat situations this can potentially cause a loss of life.

The problems of charging a magazine by hand are particularly great when either (a) the magazine cannot be charged vertically downwardly or (b) the cartridges are short i.e., have a length less than about 3 cm. The magazine cannot be charged vertically downwardly then it is necessary to depress all previously loaded cartridges before additional cartridges can be loaded axially rearwardly. In cases where the cartridges are short it is difficult or impossible to charge a magazine by use of only human hands. Both of these problems and other problems occur in connection with the widely popular 9 mm magazine which has recently become the standard for armed forces of the North Atlantic Treaty Organization (NATO).

Many attempts have been made to overcome these problems and to provide magazine chargers. Examples of prior attempts are disclosed by Northover in U.S. Pat. No. 1,355,684 issued in 1920; and by Holec in U.S. Pat. No. 1,786,537 issued in 1930; and by McPheaters in U.S. Pat. No. 2,403,012 issued in 1946; and by Drew in U.S. Pat. No. 2,864,193 issued in 1958; and most recently by Mears in U.S. Pat. No. 4,570,371 issued on the 18th day of February 1986.

All the above described magazine chargers suffer from one or more disadvantages. Many are expensive to make. Several do not function in the manner in which they are designed. Some cannot be efficiently operated by a single person.

Accordingly it is an object of the present invention to provide an improved magazine charger which is substantially free of one or more of the disadvantages of prior chargers. Another object is to provide an improved magazine charger which is inexpensive to manufacture.

Another object is to provide an improved magagzine charger which can be employed to quickly and efficiently charge cartridges to a magazine.

Still another object is to provide an improved magazine charger that can be operated by a single individual.

Yet another object of the present invention is to provide an improved magazine charger which is essentially useful with 9 mm cartridges.

Figure 1:
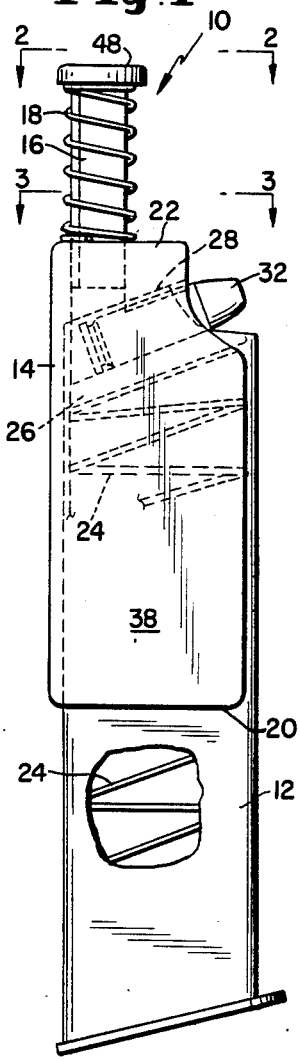
Figure 2:
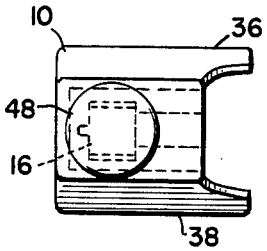
Figure 3:
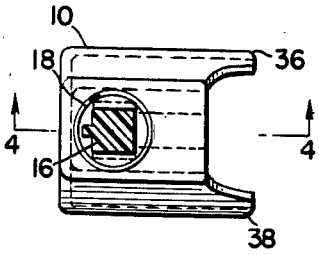
Figure 4:
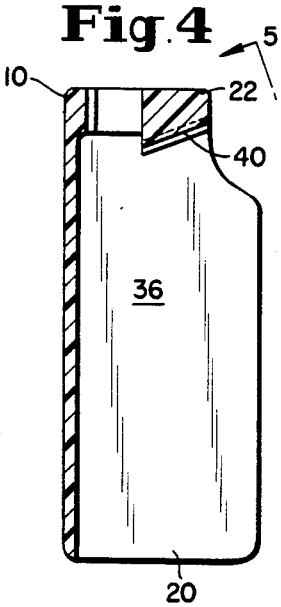
Figure 5:
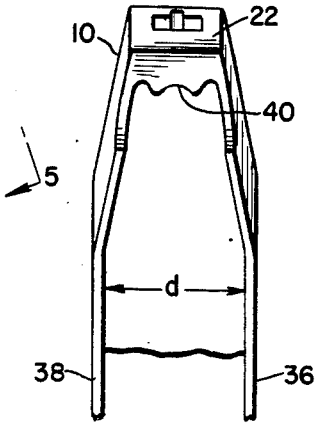
Figure 6:
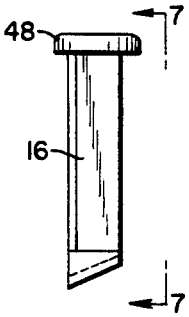
Figure 7:
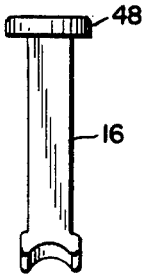
Figure 8:
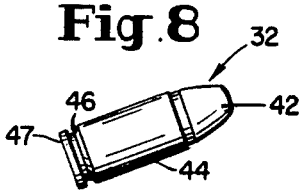
Figure 10:
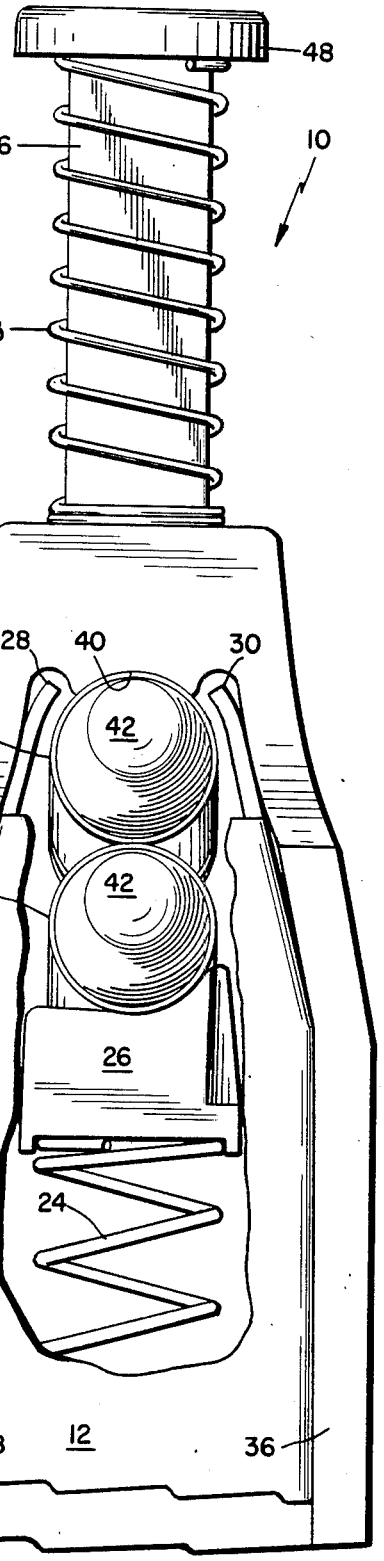
Figure 9:
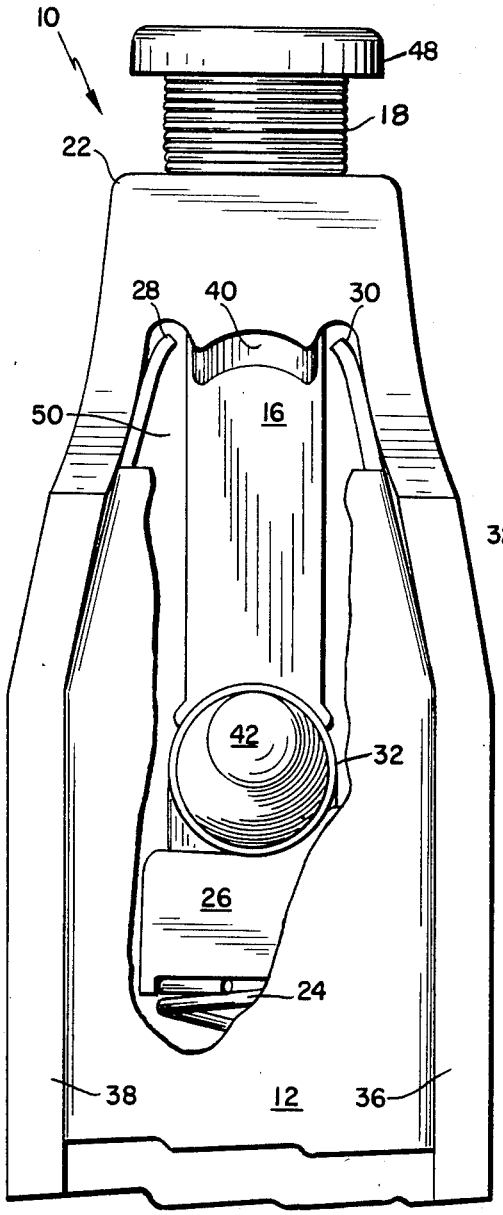

Additional objects and advantages of the present invention will be apparent to those skilled in the art by reference to the following detailed description and drawings wherein:

FIG. 1 is a side view of a magazine charger of the present invention shown approximately full scale; and FIG. 2 is a top view taken along line 2—2 of FIG. 1; and FIG. 3 is a sectional view taken along line 3—3 of FIG. 1; and FIG. 4 is a sectional view taken along line 4—4 of FIG. 3; and FIG. 5 is an oblique side view taken along line 5—5 of FIG. 4; and FIG. 6 is a side view of a plunger useful with the magazine charger of the present invention; and FIG. 7 is a side view taken along line 7—7 of FIG. 6; and FIG. 8 is a side view of a cartridge which can be charged to a magazine by use of the magazine charger of the present invention; and FIG. 9 is an enlarged partially cut away view of the magazine charger of the present invention with the plunger depressed, viewed generally from the right hand side of FIG. 1 on an enlarged scale; and FIG. 10 is a view similar to that of FIG. 9 but with the plunger upwardly extended.

The above and other objects are accomplished according to the present invention by providing a magazine charger comprising a body, a plunger, and a plunger spring. The body has an open end which constitutes means for receiving a magazine to be charged with cartridges. The magazine has a magazine spring. The body further comprises a closed end which is opposite the open end. The plunger is axially, slidably carried by the closed end of the body of the charger. The plunger is adapted to move cartridges against the magazine spring. The plunger spring biases the plunger away from the opened end of the charger.

In a preferred embodiment the plunger is operable to sequentially depress the uppermost cartridge thereby facilitating feeding of cartridgegs to the magazine.

Referring now to the drawings in general and to FIG. 1 in particular there is shown a magazine charger 10 of the present invention. The charger 10 is especially useful for charging 9 mm cartridges to a magazine 12. The charger 10 comprises a body 14, a plunger 16 and a pluner spring 18.

In the embodiment shown the body 14 is constructed of a single piece of resinous thermoplastic. The body 14 has an open end 20 and a closed end 22 (see FIG. 4). The open end 20 constitutes means for receiving the magazine 12.

The charger 10 of the present invention is adapted to be used with a conventional well-known magazine 12. In such a magazine 12 there is a cartridge follower 26 which is biased toward the open end of the magazine 12 by a magazine spring 24.

The significant structural features of the known magazine 12 are best understood by looking briefly at FIGS. 9 and 10. As shown therein the magazine 12 is equipped with a magazine spring 24 which upwardly urges a cartridge follower 26. The magazine 12 terminates in a left lip 28 and a right lip 30. The lips 28, 30 are juxtaposed with respect to each other; they are cartridge retaining lips which keep the cartridges within the magazine. In order to perform this function they are spaced from each other a distance less than the diameter of a single cartridge such as the cartridges 32, 34.

Referring now to FIGS. 1 thru inclusive it can be seen that the body 14 carries legs 36, 38. The distance "d" (see FIG. 5) between the legs 36, 38 is less than the width of the magazine 12. This causes the legs 36, 38 to tightly and firmly grip the magazine 12.

The body 14 of the charger 10 also carries a saddle 40 the surface of which is lower than the cartridge-retaining lips 28, 30 of the magazine 12 (see FIGS. 9 and 10). As explained more completely below insertion of a cartridge such as the cartridge 34 into the magazine 12 causes the cartridge 34 to slide along the saddle 40 while remaining out of contact with the lips 28, 30.

Referring now to FIGS. 1, 6 and 7 it can be seen that the plunger 16 is axially slidably carried by the closed end 22 of the body 14 (see FIG. 3). Furthermore, as shown in FIGS. 9 and 10 the plunger 16 is adapted to move cartridges such as the cartridges 32, 34 against the magazine spring 24. Thus, the plunger 16 is operable to sequentially depress the uppermost cartridge 32, or 34 facilitating the feeding of additional cartridges to the magazine 12. The plunger 16 contacts the uppermost cartridge 32 behind the forward edge of the cartridge retaining lips 28, 30. The plunger 16 has a stroke which is greater than the diameter of a single cartridge such as the cartridge 32 in order to depress the cartridge 32 downwardly a distance sufficient to insert a cartridge such as the cartridge 34.

As shown in FIG. 8 a typical 9 mm cartridge such as the cartridge 32 comprises a projectile 42 held in a casing 44. The casing 44 is provided with an extractor recess 46 and a rim 47.

In operation the magazine charger is employed to charge a magazine as follows. An empty magazine is first charged with a cartridge 32 in any convenient manner or in the manner described below. Thereafter, finger pressure is applied on the top 48 of the plunger 16 causing the plunger 16 to downwardly move a full stroke. At this point the plunger spring 18 is fully compressed as shown in FIG. 9. Furthermores, the first cartridge 32 is moved away from the saddle 40. It is also moved downwardly against the upward force of the magazine spring 24. This leaves a space 50 between the saddle 40 and the first cartridge 32. This space 50 is ideally adapted to receive a second cartridge 34. Next, a second cartridge 34 is manually inserted in the space 50 between the saddle 40 and the first cartridge 32. The second cartridge 34 lightly contacts the plunger 16.

Next, finger pressure on the top 48 of the plunger 16 is released permitting the plunger 16 to rise under the influence of the force exerted by the plunger spring 18 thus permitting the plunger 16 to assume the position shown in FIG. 10.

In this manner the plunger 16 is no longer behind the cartridge 34. The cartridge 34 is further manually inserted until the rim 47 of the cartridge 34 contacts the rear wall (not shown) of the magazine 12.

In order to fill the magazine 12 with cartridges to capacity it is only necessary to continually repeat the above steps in the order recited.

The charger 10 of the present invention can be constructed of a wide variety of materials. Thus, the charger 10 can be metal or plastic. The preferred materials are resinous thermoplastics such as polypropylene or nylon. Nylon 66 is the most preferred material.

The charger 10 of the present invention can be employed with a wide variety of cartridges. However, it is especially useful with the standard 9 mm cartridge having an outside diameter of about 0.390 inches and having a length of about 1.16 inches. Such cartridges are too short to be manually charged to a magazine with any facility whatsoever.

Although the invention has been described in considerable detail with reference to certain preferred embodiments thereof, it will be understood that modifications can be made without departing from the spirit of the invention as defined above and as described in the following claims.

What is claimed is:

1. A magazine chargr for charging cartridges to a magazine; said magazine charger comprising;

A. a body comprising:

(1) an open end constituting means for receiving a magazine to be charged with cartridges; wherein the magazine has a magazine spring which biases cartridges toward two juxtaposed, cartridge-retaining lips carried by the magazine; and (2) a closed end opposite the open end; and (3) a saddle, the surface of which is lower than the cartridge-retaining lips of the magazine;

whereby insertion of a cartridge into the magazine causes the cartridge to slide along the saddle while remaining out of contact with the lips of the magazine; and B. a plunger axially, slidably carried by the closed end of the body of the charger and adapted to move cartridges against the magazine spring; and C. means for biasing the plunger away from the open end of the charger.

2. The charger of claim 1 for use with a magazine having cartridge retaining lips spaced from each other a distance less than the diameter of a single cartridge.

3. The magazine charger of claim 2 wherein the plunger contacts the uppermost cartridge in the magazine behind the forward edge of the cartridge retaining lips.

4. The magazine charger of claim 1 wherein the plunger has a stroke which is greater than the diameter of a single cartridge.

5. The magazine charger of claim 1 wherein the body is constructed from a single piece of material.

6. The magazine charger of claim 1 wherein the body is constructed from a resinous thermoplastic.

7. The magazine charger of claim 6 wherein the resinous thermoplastic is polyproplene.

8. The magazine charger of claim 6 wherein the resinous thermoplastic is nylon.

9. The magazine cartridge of claim 1 wherein the body further comprises two legs which are juxtaposed and are spaced from each other by a distance less than the width of the magazine thereby causing the legs to tightly and firmly grip the magazine.

10. The magazine charger of claim 1 for use with a magazine adapted to receive a standard 9 mm cartridge having an outside diameter of about 0.390 inches and having a length of about 1.16 inches.

11. A magazine charger for charging 9 mm cartridges to a magazine; said magazine charger comprising:

A. a single-pice body of resinous thermoplastic material comprising:

(1) an open end constituting means for receiving a magazine to be charged with cartridges;

wherein the magazine has a magazine spring which biases cartridges toward two juxtaposed, cartridge-retaining lips carried by the magazine; and wherein the cartridge-retaining lips are spaced from each other a distance less than the diameter of a single cartridge; and (2) a closed end opposite the open end; and (3) two juxtaposed depending legs attached to the body wherein the legs constitute means for gripping the magazine; and wherein the two legs are spaced from each other by a distance less than the width of the magazine thereby causing the legs to tightly and firmly grip the magazine; and (4) a saddle, the surface of which is lower than the cartridge-retaining lips of the magazine; and wherein insertion of a cartridge into the magazine causes the cartridges to slide along the saddle while remaining out of contact with the lips of the magazine; and B. a plunger axially, slidably carried by the closed end of the body of the charger and adapted to move cartridges against the magazine spring; and whereby the plunger is operable to sequentially depress the uppermost cartridge facilitating feeding of the cartridges to the magazine; and wherein the plunger contacts the uppermost cartridge in the magazine behind the forward edge of the cartridge retaining lips; and wherein the plunger has a stroke which is greater than the diameter of a single cartridge; and C. means for biasing the plunger away from the open end of the charger; said means constituting a spring which surrounds the plunger and biases the upper edge of the plunger away from the body of the magazine;

whereby the charger is used to charge a magazine by:

I. first applying finger pressure on the plunger causing the plunger to downwardly move a full plunger stroke completely compressing the plunger spring thereby moving a first cartridge away from the saddle and moving the first cartridge downwardly against the upper face of the magazine spring thereby leaving a space between the saddle and the first cartridge; and then II. manually inserting a second cartridge in the space between the saddle and the first cartridge by lightly contacts the plunger; and then III. releasing finger pressure on the top of the plunger thereby permitting the plunger to rise under the influence of the force exerted by the plunger spring; and then IV. further manually inserting the cartridge until the cartridge contacts the rear wall of the magazine; and then V. continually repeating Steps I, II, III and IV in that order until the magazine is filled to capacity with cartridges.

* * * * *